US011988463B2

(12) United States Patent
Reagen et al.

(10) Patent No.: US 11,988,463 B2
(45) Date of Patent: May 21, 2024

(54) MICROCHANNEL HEAT EXCHANGER FOR APPLIANCE CONDENSER

(71) Applicant: Brazeway, Inc., Adrian, MI (US)

(72) Inventors: Scot Reagen, Sylvania, OH (US); Matt Baker, Onsted, MI (US); David Wayne Skrzypchak, Adrian, MI (US); Scott C. Peters, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

(21) Appl. No.: 17/697,988

(22) Filed: Mar. 18, 2022

(65) Prior Publication Data

US 2022/0299275 A1 Sep. 22, 2022

Related U.S. Application Data

(60) Provisional application No. 63/163,117, filed on Mar. 19, 2021.

(51) Int. Cl.

| | |
|---|---|
| ***F28F 1/12*** | (2006.01) |
| ***F28D 1/053*** | (2006.01) |
| ***F28F 1/02*** | (2006.01) |

(52) U.S. Cl.

CPC ..... *F28F 1/126* (2013.01); *F28D 1/05391* (2013.01); *F28F 1/022* (2013.01); *F28F 2260/02* (2013.01)

(58) Field of Classification Search

CPC ..... F28F 1/126; F28F 1/022; F28F 2260/02; F28D 1/05391

See application file for complete search history.

(56) References Cited

U.S. PATENT DOCUMENTS 4,558,695 A * 12/1985 Kumazawa ..... F28D 1/0391 228/159
4,653,580 A * 3/1987 Steele ..... F28D 1/0535 165/DIG. 476

(Continued)

FOREIGN PATENT DOCUMENTS

CN 101738010 A 6/2010
DE 102014106398 A1 11/2014

(Continued)

OTHER PUBLICATIONS

International Search Report and Written Opinion regarding International Patent Application No. PCT/US2022/020978, dated Jun. 30, 2022.

(Continued)

*Primary Examiner* — Raheena R Malik
(74) *Attorney, Agent, or Firm* — Harness, Dickey & Pierce, P.L.C.

(57) ABSTRACT

A heat exchanger that includes a microchannel tube having a plurality of straight sections interconnected by a plurality of bent sections; a plurality of accordion-style fins located between adjacent straight sections of the microchannel tube; and a plurality of brackets having a plurality of slots formed therein that are each configured for receipt of a respective straight section of the microchannel tube, wherein the plurality of brackets are configured to compress the accordion-style fins into direct engagement with the adjacent straight sections of microchannel tube, and wherein at least one of the accordion-style fins and the microchannel tube includes a mating feature that prevents lateral movement of the accordion-style fin relative to the adjacent straight sections of the microchannel tube.

20 Claims, 10 Drawing Sheets

(56) References Cited

U.S. PATENT DOCUMENTS

| | | | | |
|---|---|---|---|---|
| 6,253,839 | B1 * | 7/2001 | Reagen | B23P 15/26 165/182 |
| 6,397,939 | B1 * | 6/2002 | Swiger | F28F 1/022 165/173 |
| 7,703,299 | B2 * | 4/2010 | Schlosser | F28D 1/05383 62/347 |
| 9,551,539 | B2 | 1/2017 | Lee et al. | |
| 9,915,437 | B2 * | 3/2018 | Aynur | F28D 1/047 |
| 10,139,172 | B2 * | 11/2018 | Hunt | F28F 1/128 |
| 10,215,503 | B2 | 2/2019 | Nakajima et al. | |
| 11,499,210 | B2 * | 11/2022 | Ito | F28F 1/022 |
| 2014/0109609 | A1 | 4/2014 | Yoshida et al. | |
| 2014/0332188 | A1 | 11/2014 | Chen et al. | |
| 2014/0374077 | A1 | 12/2014 | Lee et al. | |
| 2015/0034289 | A1 * | 2/2015 | Seo | F28F 1/128 165/173 |
| 2017/0030662 | A1 * | 2/2017 | Lee | F25B 39/00 |
| 2017/0211886 | A1 * | 7/2017 | Morimura | F28D 1/05383 |

FOREIGN PATENT DOCUMENTS

| | | | |
|---|---|---|---|
| DE | 202017102436 | U1 | 11/2017 |
| EP | 0339552 | B1 | 7/1993 |
| EP | 1715276 | A2 | 10/2006 |
| EP | 2947411 | A1 | 11/2015 |
| FR | 2875591 | A1 | 3/2006 |
| JP | 5390008 | B2 | 1/2014 |
| KR | 10-2006-0033206 | A | 4/2006 |
| KR | 10-2012-0054345 | A | 5/2012 |
| KR | 101888302 | B1 | 8/2018 |
| WO | 2005-031240 | A1 | 4/2005 |
| WO | 2018029203 | A1 | 2/2018 |
| WO | 2020081389 | A1 | 4/2020 |

OTHER PUBLICATIONS

International Preliminary Report on Patentability issued in PCT/US2022/020978 dated Sep. 12, 2023.

* cited by examiner

MICROCHANNEL HEAT EXCHANGER FOR APPLIANCE CONDENSER

CROSS-REFERENCE TO RELATED APPLICATIONS

This application claims the benefit of U.S. Provisional Application No. 63/163,117, filed on Mar. 19, 2021, the entire disclosure of which is incorporated herein by reference.

FIELD

The present disclosure relates to a microchannel heat exchanger for an appliance condenser.

BACKGROUND

This section provides background information related to the present disclosure which is not necessarily prior art.

Heating, ventilation, air conditioning and refrigeration (HVAC&R) systems include heat exchangers to reject or accept heat between the refrigerant circulating within the system and its surrounding environment. One type of heat exchanger that has become increasingly popular due to its compactness, structural rigidity, and superior performance is a microchannel heat exchanger. A microchannel heat exchanger includes a tube through which a cooling or heating fluid (e.g., refrigerant) is circulated. The tube typically has a flattened cross-section and multiple parallel flow channels formed therein. Fins are typically arranged to extend between the sections of the tube to assist in the transfer of thermal energy between the heating/cooling fluid and the surrounding environment. The fins may have a corrugated pattern, incorporate louvers to boost heat transfer, and are typically secured to the tube via brazing.

Brazing the fins and the microchannel tube together minimizes contact resistance between the fins and the microchannel tube. The brazing material may be clad on the fins or coated on the tube. The process of brazing, however, is expensive and the material cost to clad the fin or coat the tube with the brazing material is significantly greater than the material costs associated with non-brazed heat exchangers. The brazing process is also not necessarily environmentally friendly, as the process uses flux chemicals and has high energy requirements. There is a desire, therefore, for a microchannel heat exchanger that does not require brazing and exhibits similar performance in a HVAC&R application.

SUMMARY

This section provides a general summary of the disclosure and is not a comprehensive disclosure of its full scope or all of its features.

According to a first aspect, the present disclosure provides a heat exchanger that includes a microchannel tube having a plurality of straight sections interconnected by a plurality of bent sections; a plurality of accordion-style fins located between adjacent straight sections of the microchannel tube; and a plurality of brackets having a plurality of slots formed therein that are each configured for receipt of a respective straight section of the microchannel tube, wherein the plurality of brackets are configured to orient adjacent straight sections of the microchannel tube such that the plurality of accordion-style fins located between the adjacent straight sections of the microchannel tube are compressed by the adjacent straight sections of tube.

According to the first aspect, the accordion-style fins are compressed by the adjacent straight sections of the microchannel tube a distance that lies in the range of 0.003 inches to 0.015 inches.

According to the first aspect, at least one of the accordion-style fins and the microchannel tube includes a mating feature that prevents lateral movement of the accordion-style fin relative to the adjacent straight sections of the microchannel tube.

According to the first aspect, the accordion-style fins are not brazed to the adjacent straight sections of microchannel tube.

According to the first aspect, the microchannel tube may include a planar upper major surface and a planar lower major surface, and the mating feature includes at least one protrusion that extends longitudinally along each of the planar upper surface and the planar lower surface, and the accordion-style fin positioned between adjacent straight sections of microchannel tube may include a pair of recesses that are configured to mate with a respective protrusion formed on the adjacent straight section of microchannel tube.

According to the first aspect, a plurality of laterally spaced apart protrusions may be formed on each of the planar upper major surface and the planar lower major surface, and the accordion-style fin positioned between adjacent straight sections of microchannel tube may include a plurality of recesses that are configured to mate with respective protrusions formed on the adjacent straight section of microchannel tube.

According to the first aspect, the microchannel tube may include a planar upper major surface and a planar lower major surface, and a pair of side surfaces that connect the planar upper major surface and the planar lower major surface, and wherein the mating feature may include a bulbous portion formed at each side surface that defines an abutment surface that extends outward from at least one of the planar upper major surface and the planar lower major surface and contacts the accordion-style fin and restricts lateral movement of the accordion-style fin positioned between adjacent straight sections of the microchannel tube.

According to the first aspect, the mating feature may be a recessed section formed in the accordion-style fin at bent portions of the accordion-style fin, wherein the recessed section is configured for receipt of a straight section of the microchannel tube such that the microchannel tube is restricted from moving laterally relative to the accordion-style fin.

According to the first aspect, the recessed section may have a depth that permits the bent portions of the accordion-style fin to extend outward from the microchannel tube.

According to the first aspect, the accordion-style fin may include a pair of tabs at the recessed section that are bent away from the bent portion, and the microchannel tube is seated on the pair of tabs.

According to the first aspect, the plurality of slots of the bracket may be separated by a finger having a tapered distal end.

According to the first aspect, the plurality of slots may be formed as a plurality of apertures configured for receipt of the microchannel tube therein.

According to the first aspect, the heat exchanger may further include a pair of planar support members that sandwich the heat exchanger are mated to the plurality of brackets.

According to a second aspect of the present disclosure, there is provided a heat exchanger that includes a microchannel tube having a plurality of straight sections interconnected by a plurality of bent sections; a plurality of accordion-style fins located between adjacent straight sections of the microchannel tube; and a plurality of brackets having a plurality of slots formed therein that are each configured for receipt of a respective straight section of the microchannel tube, wherein the microchannel tube includes an upper major surface and a lower major surface that each include plurality of projections that extend longitudinally at least along each of the plurality of straight sections; and the accordion-style fins located between adjacent straight sections of microchannel tubes include a plurality of recesses that are configured to mate with the plurality of projections such that when the recesses are mated with the projections, the accordion-style fins are restricted from moving laterally relative to the adjacent straight sections of the microchannel tube.

According to the second aspect, each accordion-style fin includes a plurality of planar portions connected by bent portions, wherein the bent portions are configured to contact the upper and lower major surfaces of the microchannel tube when the accordion-style fin is positioned between adjacent straight sections of the microchannel tube, and the recesses are formed at the bent portions.

According to the second aspect, the bent portions are not brazed to the upper and lower major surfaces of the adjacent straight sections of microchannel tube.

According to the second aspect, the plurality of brackets are configured to orient adjacent straight sections of the microchannel tube such that the plurality of accordion-style fins located between the adjacent straight sections of the microchannel tube are compressed by the adjacent straight sections of tube.

According to the second aspect, the plurality of slots of the bracket are separated by a finger having a tapered distal end.

According to the second aspect, the heat exchanger may further include a pair of structural members attached to the brackets that sandwich the heat exchanger.

According to the second aspect, mating between the plurality of protrusions and plurality of recesses does not restrict longitudinal movement of the accordion-style fin relative to the adjacent straight sections.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
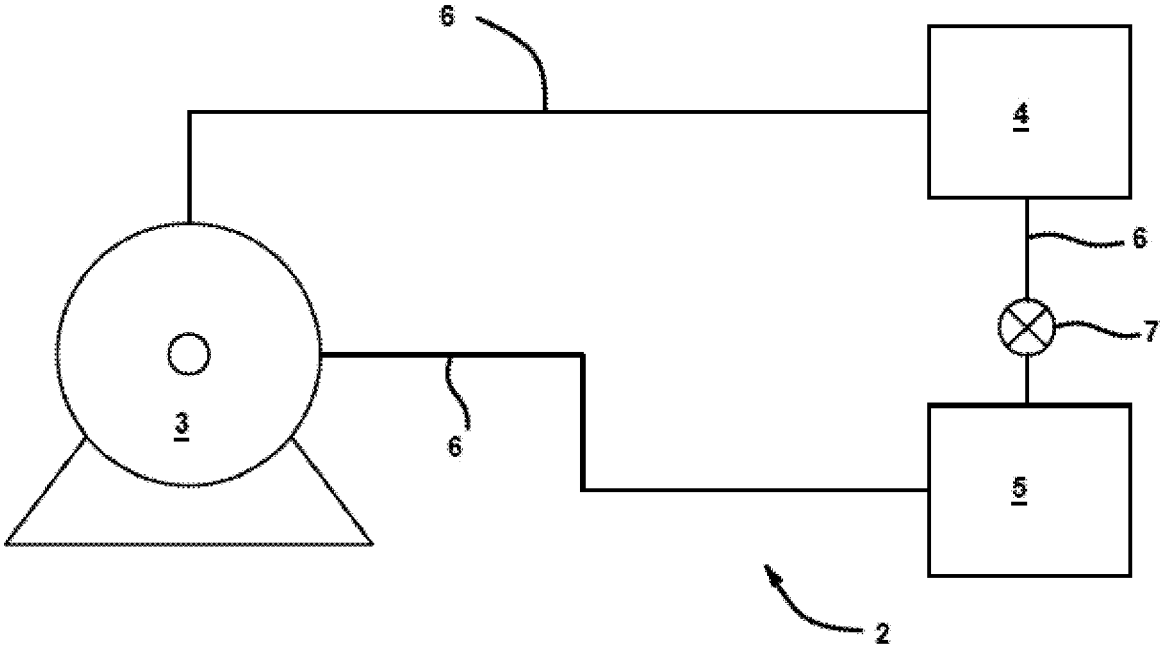
FIG. 1 is a schematic representation of a HVAC&R system according to a principle of the present disclosure.

FIG. 1 illustrates a refrigeration system 2 that may generally include a compressor 3, a condenser 4, and an evaporator 5 that are connected by connection lines 6. Condenser 4 and evaporator 5 are what are known as heat exchangers. Refrigeration system 2 may be incorporated into an appliance (e.g., a refrigerator or freezer), refrigeration system 2 may be used in a residential or commercial environment to cool and/or heat a structure. Disposed between condenser 4 and evaporator 5 may be an expansion device 7 such as a valve or capillary tube. Compressor 2 receives low-pressure refrigerant from evaporator 5 through one of the connection lines 6 at a suction side and dispenses high-pressure refrigerant at a discharge side through another of the connection lines 6 to condenser 4.

During refrigeration, refrigeration system 2 uses the cooling effect of evaporation of the refrigerant to lower the temperature of the surroundings near one heat exchanger (i.e., evaporator 5) and uses the heating effect of high pressure, high temperature gas to raise the temperature of the surroundings near another heat exchanger (i.e., condenser 4). This is usually accomplished by releasing a refrigerant under pressure (usually in a liquid phase) into a low pressure region to cause the refrigerant to expand into a low temperature mixture of liquid and vapor. Commonly, this low pressure region comprises a coil that forms part of evaporator 5. Once in the evaporator coil, the refrigerant mixture may exchange heat with the tubing of the coil, which in turn exchanges heat with high temperature ambient air of the region desired to be cooled. Evaporation of refrigerant from liquid to gas absorbs heat from the ambient air and thereby cools it.

Figure 2:
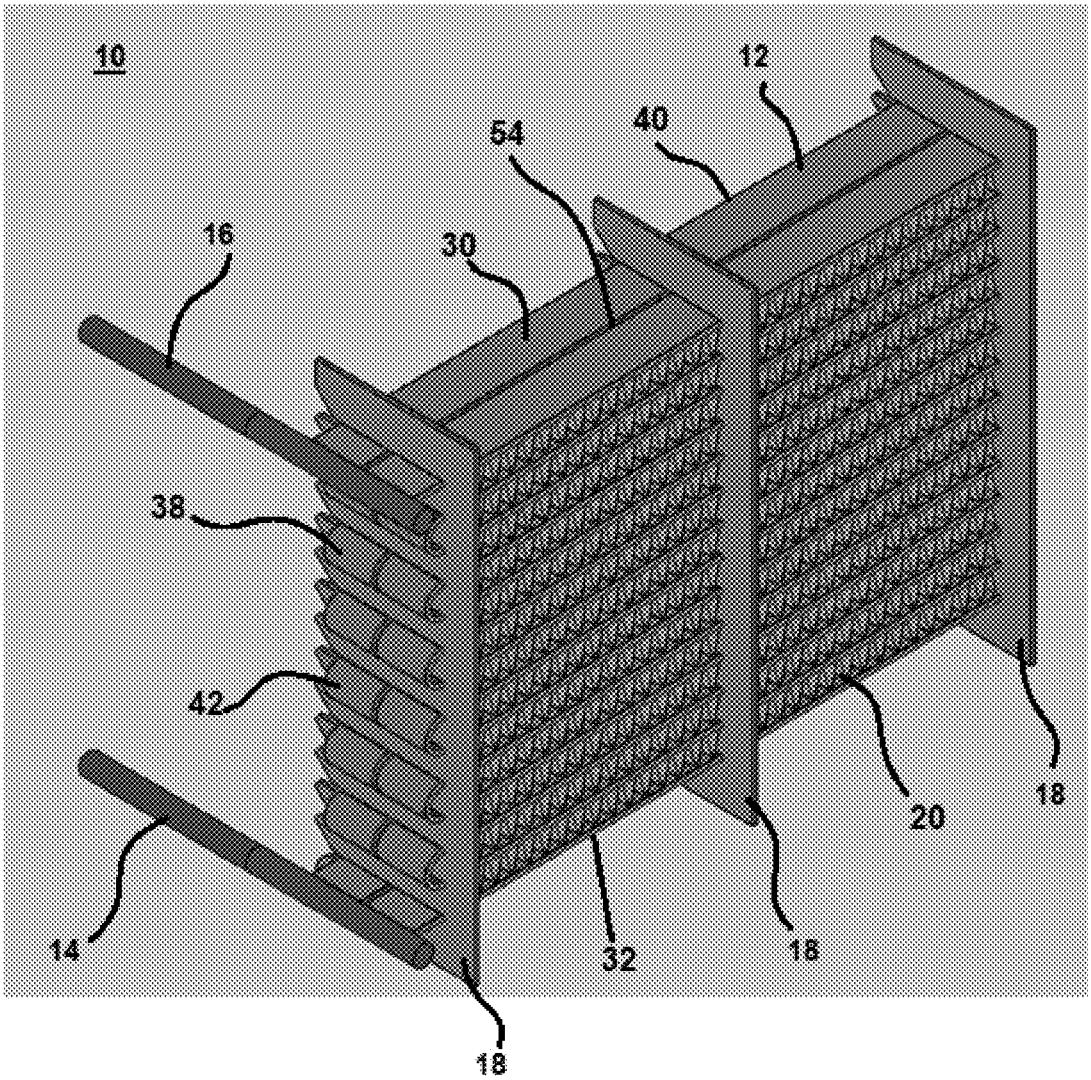
FIG. 2 is a perspective view of a heat exchanger according to a principle of the present disclosure.

FIG. 2 illustrates an example heat exchanger 10 according to a principle of the present disclosure. Heat exchanger 10 may be used as condenser 4 or evaporator 5, or each of condenser 4 and evaporator 5 may have the configuration of the heat exchanger 10 illustrated in FIG. 2. In either case, heat exchanger 10 includes a tube 12 having an inlet 14 and an outlet 16 connected thereto, a plurality of brackets 18, and a plurality of fins 20.

Figure 3:
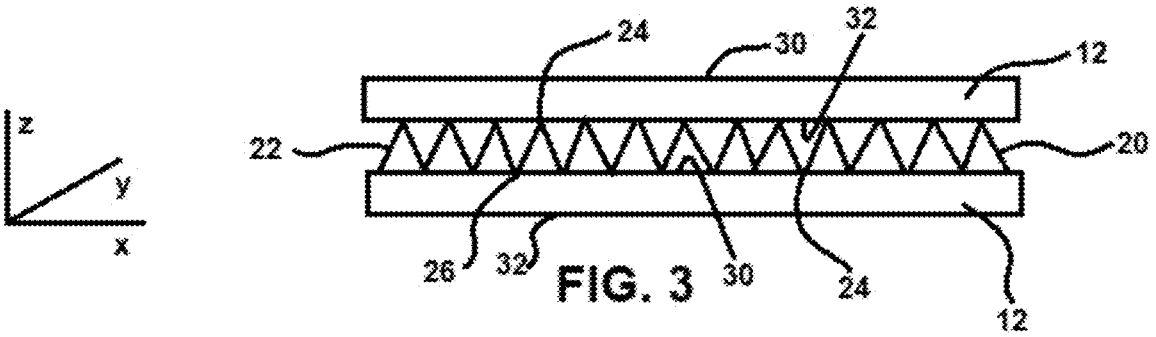
FIG. 3 is a perspective view of a fin of the heat exchanger illustrated in FIG. 2 positioned between adjacent sections of a microchannel tube of the heat exchanger illustrated in FIG. 2.

As best shown in FIG. 3, fins 20 are accordion-style fins having a plurality of planar portions 22 connected by bent portions 24, with bent portions 24 serving as contact points 26 between fin 20 and adjacent sections of tube 12, which permits heat exchange between tube 12 and fin 20. Fins 20 may be formed of any material known to one skilled in the art that is sufficient for exchange between tube 12 and fin 20. For example, fins 20 may be formed of a metal material such as aluminum, copper, or an alloy such as a steel alloy or an aluminum alloy. Preferably, for cost purposes, fins 20 are formed of aluminum or an aluminum alloy. While bent portions 24 are illustrated as being triangular, it should be understood that bent portions 24 can be rectangular, rounded, or some other shape without departing from the scope of the present disclosure.

Figure 4:
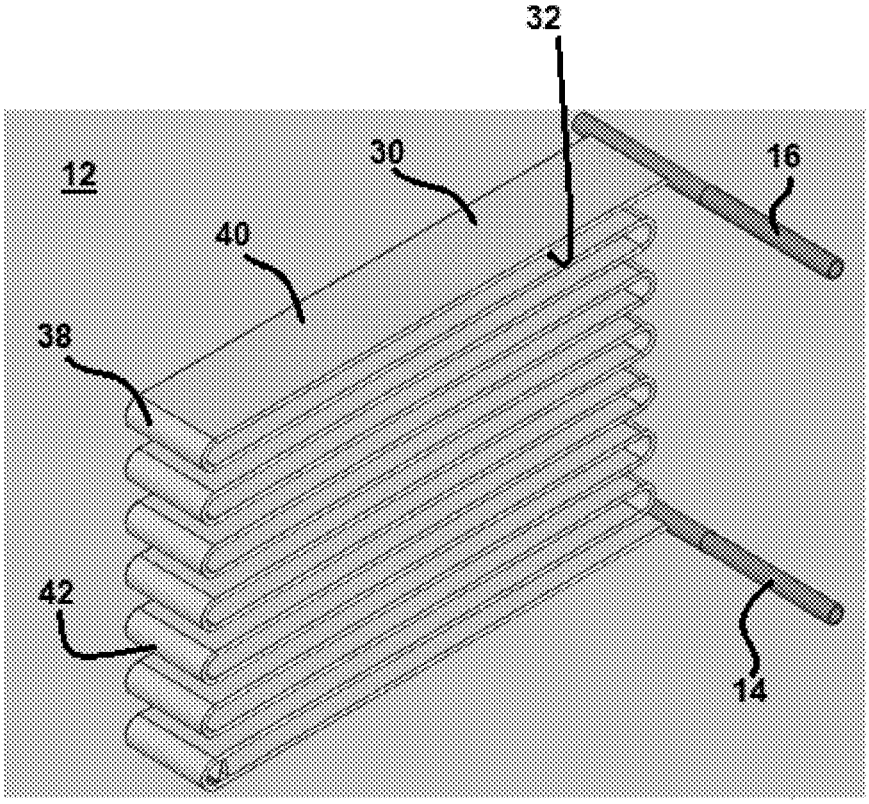
FIG. 4 is a perspective view of a tube used in the heat exchanger illustrated in FIG. 2.
Figure 5:
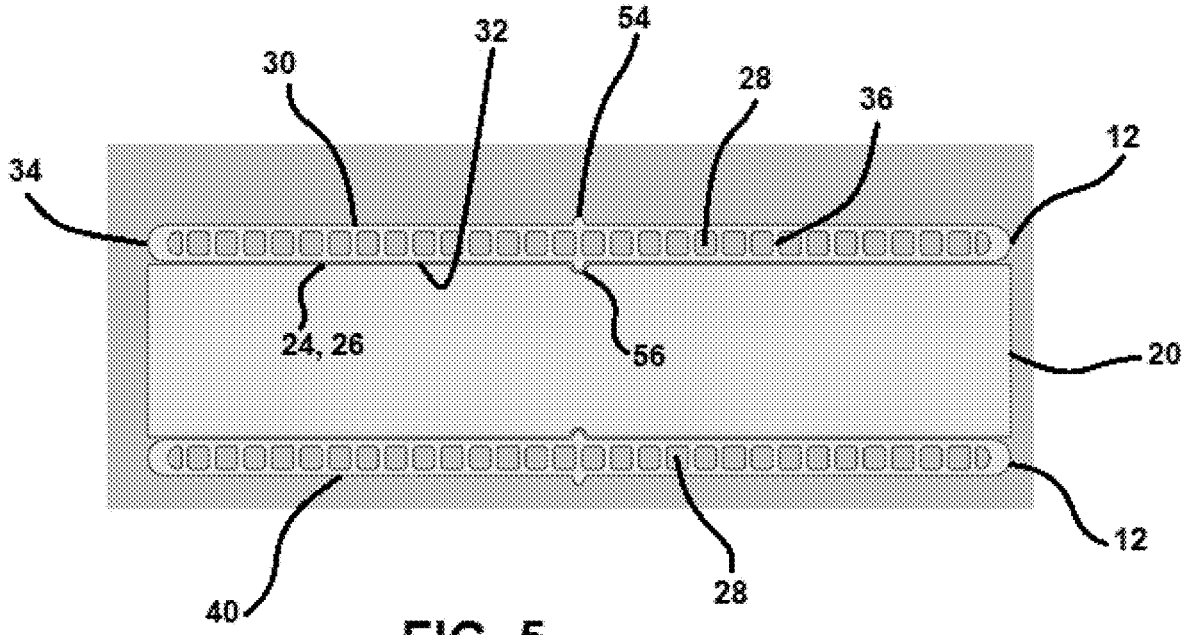
FIG. 5 is a cross-sectional view of a fin positioned between an adjacent pair of tubes that are mated with each other according to a principle of the present disclosure.

As best shown in FIGS. 4 and 5, tube 12 is a microchannel tube having a plurality of channels 28 formed therein for carrying a refrigerant. Tube 12 includes a first or upper major surface 30, a second or lower major surface 32, and a pair of side surfaces 34 that connect upper major surface 30 to lower major surface 32. A plurality of walls 36 that longitudinally extend along a length of the tube 12 and between upper major surface 30 and lower major surface 32 to define channels 28, which also extend longitudinally along the length of tube 12. While a majority of channels 28 are illustrated as being square- or rectangular-shaped in FIG. 5, it should be understood that channels 28 may have any shape in cross-section that is desired. Similar to fins 20, tube 12 may be formed of a metal material such as aluminum, copper, or an alloy such as a steel alloy or an aluminum alloy. Preferably, for costs and heat exchange purposes, tube 12 is formed of aluminum or an aluminum alloy.

In the illustrated embodiment, tube 12 may be a single tube that is bent at various locations 38 to meander back and forth through heat exchanger 10 (i.e., have a serpentine configuration). It should be understood, however, that tube 12 may be formed of multiple straight sections 40 that are each connected by a separate bent sections 42 that are subsequently joined to the straight sections 40. The bent sections 42 may be mechanically joined to straight sections 40, adhered to straight sections 40 by brazing, or attached to straight sections 40 in any manner known to one skilled in the art that is satisfactory to withstand operating pressures of the heat exchanger 10 and provide a leak-free seal between bent sections 42 and straight sections 40. Another alternative includes attaching straight sections 40 of tube 12 to headers (not illustrated) at opposing ends of the straight sections 40.

Figure 6:
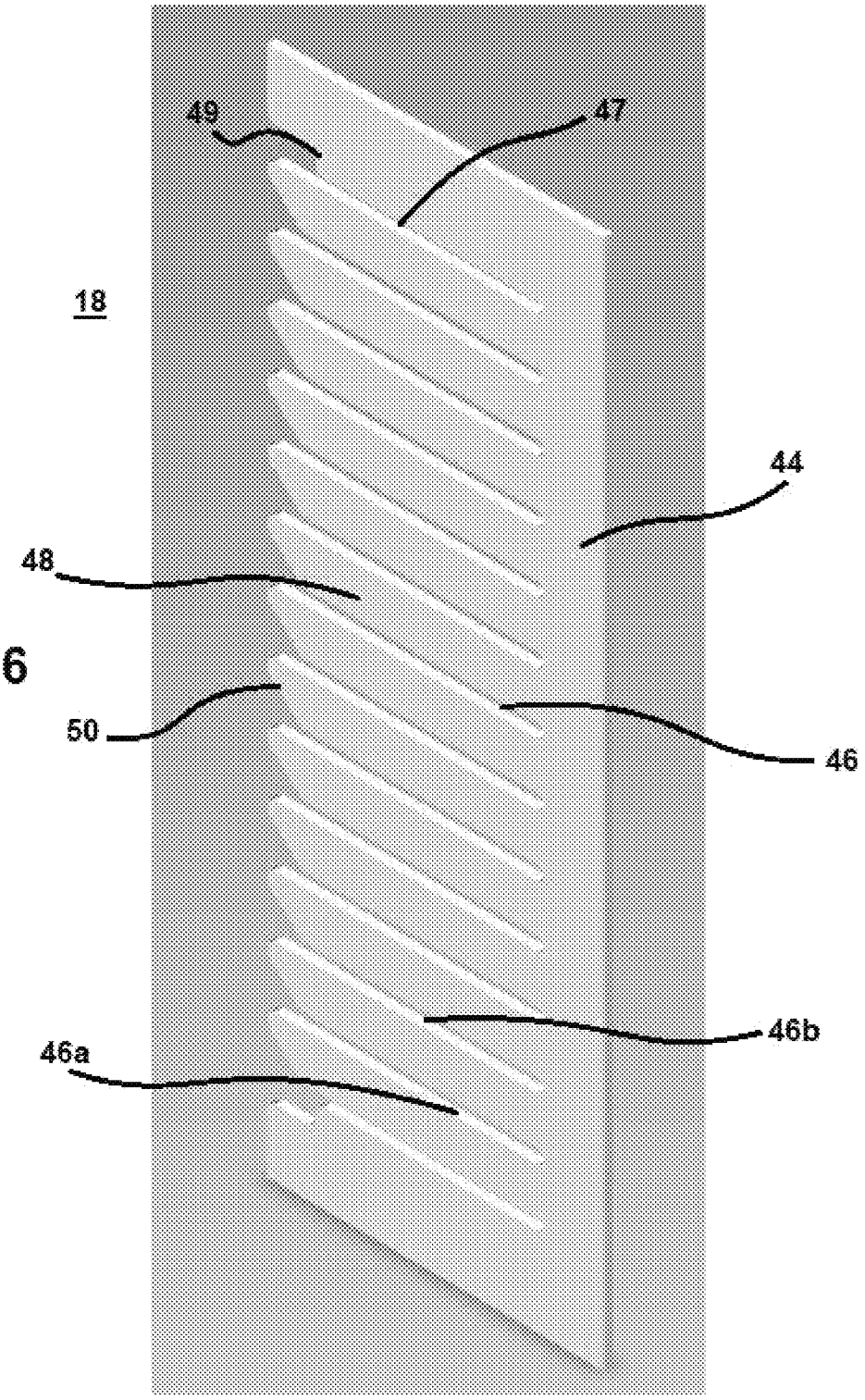
FIGS. 6 and 7 are perspective views of example brackets that may be used to compress the fins of the heat exchanger between adjacent sections of the tube of the heat exchanger.
Figure 7:
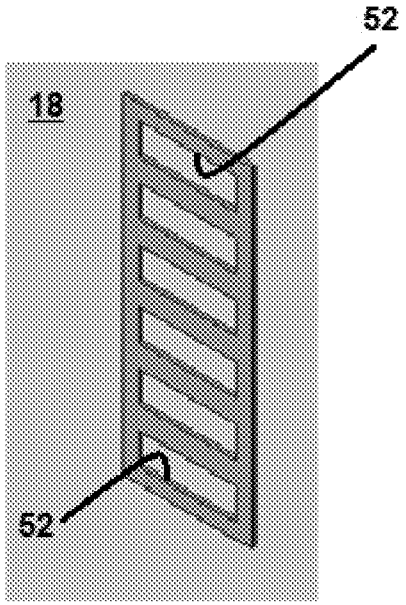

FIGS. 6 and 7 illustrate example brackets 18 that are configured to support and orient the tube 12 as it meanders back and forth through heat exchanger 10, or support straight sections 40 of tube 12 if tube 12 is not a single tube, but rather a plurality of straight sections 40 interconnected by bent sections 42. The bracket 18 in FIG. 6 is a planar body 44 having a plurality of slots 46 formed therein. Slots 46 have a width configured for receipt of tube 12. More specifically, slot **46*a* is configured for receipt of one pass of tube 12, while slot 46*b* is configured for another pass of tube 12. The number of slots 46 is variable, and is dependent on the size of heat exchanger 10 (i.e., a larger heat exchanger may have a tube 12 having a length that requires multiple passes through bracket 18**).

Each slot 46 is separated by a finger 48 that may have a tapered end 50 that assists bracket 18 in receiving a respective section of tube 12 therein. Alternatively, as best shown in FIG. 7, each bracket 18 may include elongated apertures 52 configured for receipt of a respective straight section 40 or pass of tube 12. Another alternative includes using one or a plurality of bracket 18 illustrated in FIG. 6 at a center of the heat exchanger 10 and using the brackets 18 illustrated in FIG. 7 on opposing ends of the heat exchanger 10. In any of these cases, bracket 18 may be formed a metal material such as aluminum, copper, or an alloy such as a steel alloy or aluminum alloy to assist in heat transfer between tube 12 and bracket 18. In addition, polymeric materials that are not necessarily thermally conductive may also be used.

While three brackets 18 are illustrated in FIG. 2, it should be understood that a greater or lesser number of brackets 18 can be used. For example, if tubes 12 are connected to headers (not illustrated), only a single bracket 18 may be necessary. Moreover, regardless of which bracket 18 is selected for use in heat exchanger 10, it should be understood that slots 46 and apertures 52 are spaced apart from each other such that when tube 12 is mounted to brackets 18, the brackets 18 are configured to compress tubes 12 and fins 20 into intimate (i.e., direct) contact (i.e., in the z-direction) that increases heat transfer between tubes 12 and fins 20 to exhibit a connection that is similar to a brazed connection.

More specifically, it should be understood that according to the present disclosure, the connections between brackets 18, tube 12, and fins 20 does not require brazing when heat exchanger 10 is assembled. Notwithstanding that no brazing is required to connect brackets 18, tube 12, and fins 20, heat exchanger 10 exhibits similar heat exchange capability in comparison to a heat exchanger where fins 20 are brazed to tubes 12. In addition, the cost to manufacture heat exchanger 10 that does not include brazed connections between brackets 18, tube 12, and fins 20 is much lower in comparison to a brazed heat exchanger.

In this regard, when manufacturing heat exchanger 10, tube 12 is bent into the serpentine shape as illustrated in FIG. 2. Then, the accordion-style fins 20 are placed loosely between straight sections 40 of tube 12. After fins 20 are placed loosely between straight sections 40 of tube 12, brackets 18 are attached to tube 12 such that each pass of tube 12 is held in a slot 46 of bracket 18. As brackets 18 are attached to the straight sections 40 of tube 12, each fin 20 located between adjacent straight sections 40 of tube 12 are compressed (in the z-direction in FIG. 3) to an extent such that bent portions 24 are tightly engaged (i.e., directly engaged) between the lower major surface 32 of one straight section 40 of tube 12 and the upper major surface 30 of an adjacent straight section 40 of tube 12 to improve contact between tube 12 and fin 20. The slots 46 and apertures are spaced apart from each other such that fin 20 is compressed between straight sections 40 to an extent that the tight engagement is achieved, but not to an extent that fin 20 will buckle due to the compression force applied by bracket 18. That is, the brackets 18 orient the straights sections 40 to tube 20 relative to one another such that fins 20 are compressed a distance that lies in the range of 0.003 inches to 0.015 inches, with a compression distance of about 0.005 inches being preferable. Each fin 20 in heat exchanger 10 may be compressed to substantially the same extent due to use of brackets 18.

In addition, again referring to FIG. 3, it should be understood that fin 20 may be compressed in a direction toward a center of the fin 20 (i.e., by compressing fin 20 from each side in the x-direction in FIG. 3) when opposing ends of the fin 20 are contacted by brackets 18 at the opposing ends. By compressing fin in the x-direction, a pitch between contact points 26 (bent portions 24) is narrowed that forces contact points 26 upward and downward (i.e., in the z direction) to further tightly engaged with the adjacent sections 40 of tube 12.

It is important that the fins 20 are located correctly between adjacent straight sections 40 of tube 12 when manufacturing heat exchanger 10 to ensure proper performance of heat exchanger 10. In this regard, because fins 20 are not brazed to tube 12, if a fin 20 were to come loose during use of heat exchanger 10 it could block a fan (not illustrated) used to draw or push air through heat exchanger 10, or have other detrimental effects that could cause heat exchanger 10 to reduce its heat transfer capability.

Figure 8:
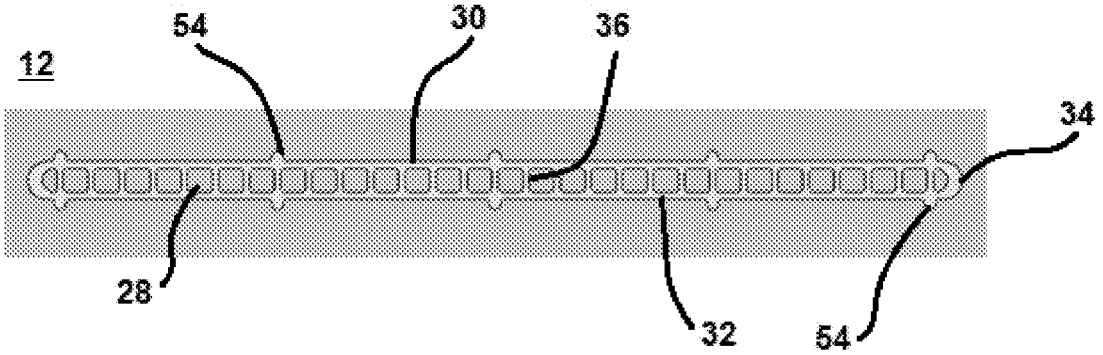
FIG. 8 is a cross-sectional view of a microchannel tube having a plurality of mating features that can be used to secure a fin of the heat exchanger thereto.

FIGS. 2 and 5 illustrate a first example connection between tube 12 and fin 20 to ensure that fin 20 is properly located relative to tube 12 when assembling heat exchanger 10. In the illustrated example, each of upper major surface 30 and lower major surface 32 includes an elongated protrusion 54. In the illustrated embodiment, protrusion 54 extends along an entire length of tube 12. It should be understood, however, that if tube 12 is formed of straight sections 40 interconnected by bent sections 42, only straight sections 40 may include the elongated protrusion 54 along a length thereof. Protrusion 54 is configured to mate with a recess 56 formed at least at bent portions 24 of fin 20. During assembly, the protrusions 54 are mated with recesses 56 to prevent fin 20 from moving laterally (i.e., in the y-direction in FIG. 3) relative to tube 12, while permitting fin 20 to move longitudinally (i.e., in the x-direction). Further, after brackets 18 are mated with tube 12 to compress fin 20 in the longitudinal direction (x-direction) to force contact points 26 into tight engagement with tube 12, fins 20 are prevented from disengaging from tube 12. While tube 12 is illustrated as having a single protrusion 54 on each of upper major surface 30 and lower major surface 32, it should be understood that tube 12 may have a plurality of protrusions 54 formed on each of upper and lower major surfaces 30, 32 (FIG. 8). If such a configuration is used, it should be understood that fin 20 will have a corresponding number of recesses 56. Moreover, while the protrusion 54 and corresponding recess 56 are illustrated as being rounded, it should be understood that the protrusion 54 and recess 56 may have any other corresponding shape (e.g., square, rectangular, or triangular) without departing from the scope of the present disclosure.

Figure 9:
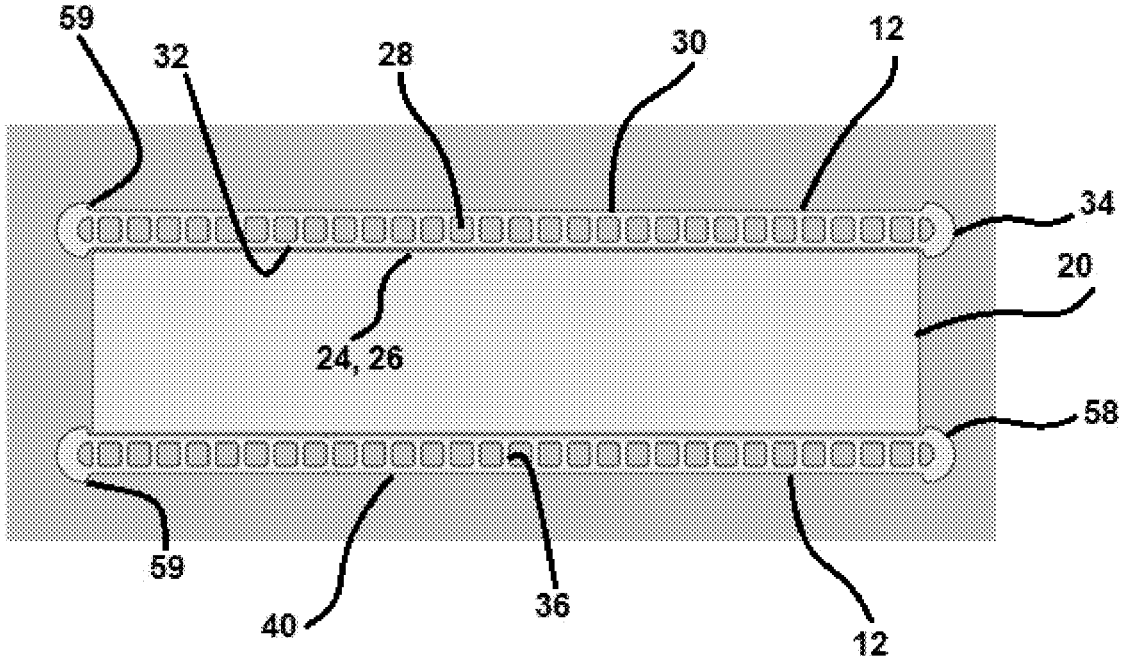
FIG. 9 is a cross-sectional view of a fin positioned between an adjacent pair of tubes that are mated with each other according to another principle of the present disclosure.

Now referring to FIG. 9, a second example connection between tube 12 and fin 20 is illustrated. In the illustrated example, fin 20 is a standard accordion-style fin, which means that fin 20 does not have a recess 56 formed therein. Notwithstanding the lack of a recess 56 that can be used to correctly orient fin 20 relative to tube 12 and ensure a good heat exchange connection between fin 20 and tube 12, to ensure that fin 20 remains properly located between adjacent sections 40 of tube 12 it can be seen that tube 12 has been modified to include a bulbous portion 58 at side surfaces 34. Bulbous portion 58 acts as a barrier on opposing sides of fin 20 that prevents fin 20 from moving laterally (i.e., in the y-direction in FIG. 3) relative to sections 40 of tube 12. Specifically, bulbous portion 58 defines abutment surfaces 59 extending outward from the upper 30 and lower surfaces 32 of tube 12 configured for restraining lateral movement of fin 20 therebetween. Further, after brackets 18 are mated with tube 12 to compress fin 20, fins 20 are prevented from disengaging from tube 12 due contact between abutment surfaces 59 and fin 20.

Figure 10:
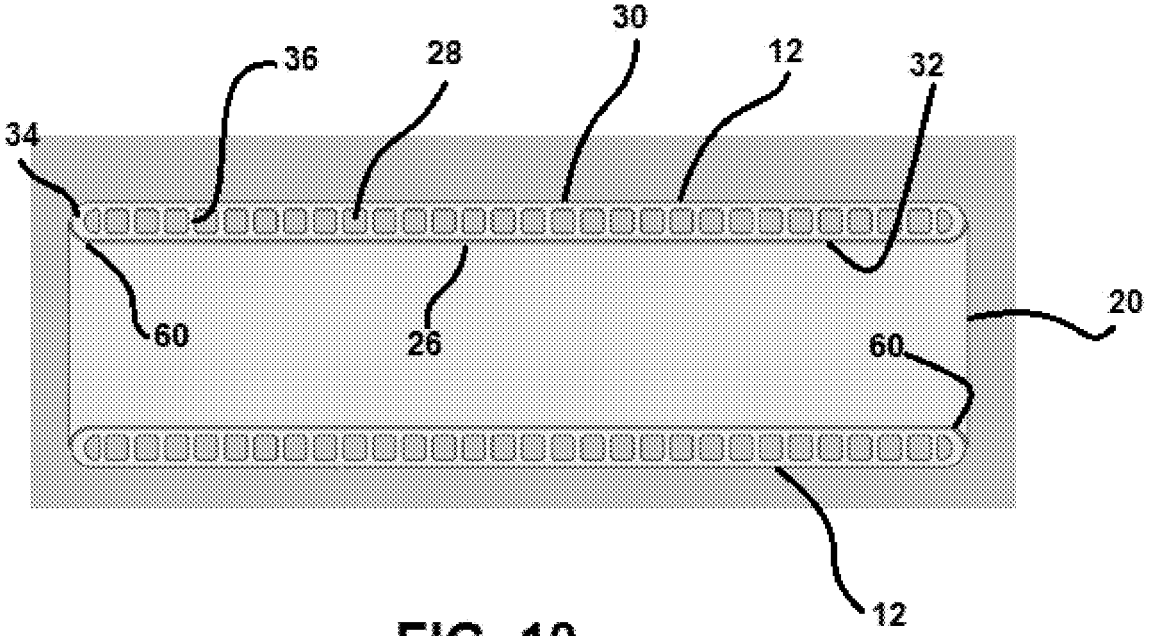
FIG. 10 is a cross-sectional view of a fin positioned between an adjacent pair of tubes that are mated with each other according to another principle of the present disclosure.

FIG. 10 illustrates a third example connection between tube 12 and fin 20. In the illustrated example, tube 12 is a standard microchannel tube, which means that tube 12 is devoid of a protrusion 54 or bulbous portion 58 as described above. To ensure that fin 20 remains properly located between adjacent sections 40 of tube 12, however, it can be seen that fin 20 has been modified to include a scalloped or recessed section 60 at least at bent portion 24 of fin 20 that extends along a width of fin 20. Scalloped section 60 is shaped to receive tube 12 therein such that fin 20 cannot move laterally relative to tube 12. Thus, scalloped section 60 can have any shape that corresponds to that of microchannel tube 12 such that fin 20 is precluded from moving laterally relative to tube 12. Moreover, while having scalloped section 60 shaped to correspond to the shape of microchannel tube 12 is preferable, it should be understood that scalloped section 60 does not necessarily have to be shaped to correspond to microchannel tube 12 and is only required to be shaped to inhibit lateral movement of fin 20 relative to tube 12.

Scalloped section 60 may be formed by stamping a plurality of apertures in a planar sheet of material that is used to form fin 12, and then the planar sheet of material can be bent to have the accordion configuration where the apertures formed at bent portions 24 of fin 20 will form scalloped section 60. Further, after brackets 18 are mated with tube 12 to compress fin 20, fins 20 are prevented from disengaging from tube 12.

Figure 11:
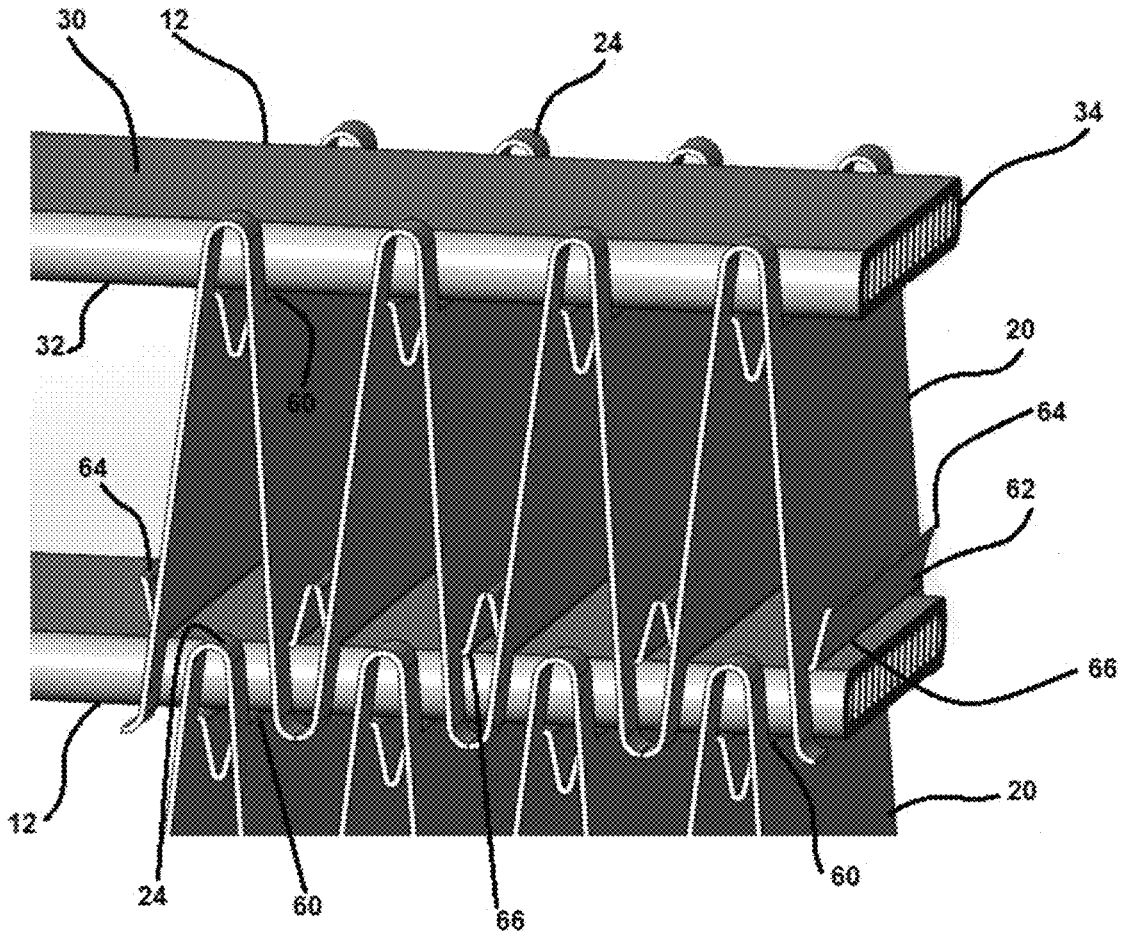
FIG. 11 is a perspective view of a fin positioned between an adjacent pair of tubes that are mated with each other according to another principle of the present disclosure.

FIG. 11 illustrates a fourth example connection between tube 12 and fin 20, which is a further modification of the example embodiment illustrated in FIG. 10. In the illustrated example, tube 12 is a standard microchannel tube, which means that tube 12 is devoid of a protrusion 54 or bulbous portion 58 as described above. To ensure that fin 20 remains properly located between adjacent sections 40 of tube 12, however, it can be seen that fin 20 has been further modified such that scalloped or recessed section 60 is deeper in comparison to that shown in FIG. 10.

Specifically, scalloped section 60 has a depth such that bent portions 24 extend away from upper major surface 30 and lower major surface 32 of tube 12 such that tube 12 is seated in scalloped portion 60 and bent portions 24 are not engaged with tube 12. Although tube 12 is not in contact with bent portions 24 of fin 20, it should be understood that intimate contact between fin 20 and tube 12 is maintained. In this regard, when scalloped section 60 is formed, the material of fin 20 that forms scalloped section 60 can be cut into a pair of tabs 62 that each have a free distal end 64 and a proximate end 66 that remains attached to fin 20. Tabs 62 may be bent in a direction away from bent portion 24 and in a direction towards each other such that the free distal ends 64 are substantially aligned with each other. Tube 12 may then sit within scalloped section 60 where proximate end 66 is connected to fin 20. Thus, fin 20 to tube 12 contact is maintained, and fins 20 are prevented from moving laterally relative to tube 12. Further, after brackets 18 are mated with tube 12 to compress fin 20, fins 20 are prevented from disengaging from tube 12.

Figure 12:
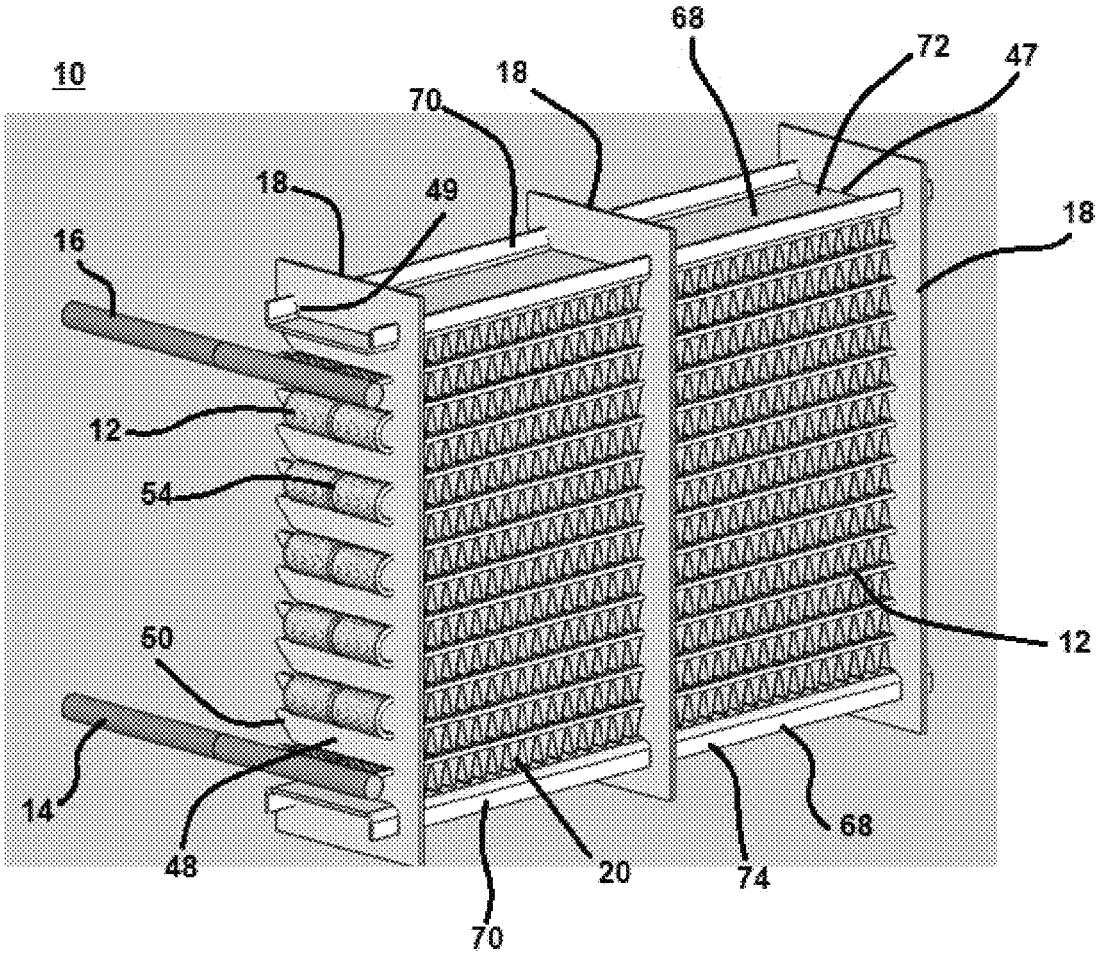
FIG. 12 is a perspective view of another heat exchanger according to a principle of the present disclosure.

FIG. 12 illustrates a configuration where a pair of structural members 68 are mated with brackets 18 on the top and bottom of heat exchanger 10. In addition to assisting with compressing the tube 12 and fins 20 throughout heat exchanger 10, it should be understood that structural members 68 may provide protection for tube 12 at the top and bottom of heat exchanger 10 to prevent tube 12 from being punctured. Structural members 68 are generally planar members having at least one lateral edge 70 thereof bent to extend away from a planar surface 72 of structural members 68 to form a flange 74 (e.g., structural member 68 may be U-shaped, or structural member 68 can be L-shaped). Bracket 18 may include a slot that is shaped for receipt of structural members 68 therethrough. For example, again referring to FIG. 6, it can be seen that a slot 47 having a notch 49 configured to mate with flange 74 may be located at opposing ends of the bracket 18 for receipt of an L-shaped structural member 68. Alternatively, structural member 68 can be sandwiched between tube 12 and slot 46 of bracket 18. In other words, tube 12 and structural member 68 are mated with bracket 18 at the same slot 46. While structural members 68 are described above as being U-shaped, it should be understood that one or both structural members 68 could have a shape such as an I-beam, a rod, or a planar bar. The important function of structural members 68 is that the members 68 assist in compressing the tube 12 and fins 20 and/or provide protection to tube 12.

In each of the above example configurations, tube 12 is not brazed to fin 20, which reduces manufacturing costs of heat exchanger 10. Indeed, after initial evaluation of heat exchanger 10, it was determined that the cost to produce heat exchanger 10 can be reduced by more than 25% in comparison to a brazed heat exchanger. Moreover, notwithstanding that tube 12 is not brazed to fins 20, it was determined that heat exchanger 10 exhibited heat transfer that was within about 3% of what is exhibited by a brazed heat exchanger. Thus, the present disclosure provides a heat exchanger 10 that exhibits satisfactory heat exchanger capability while being substantially less costly. It should also be understood that heat exchanger 10 is significantly more beneficial for the environment because no chemicals are required to manufacture heat exchanger 10 like in a conventional brazed heat exchanger.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger, comprising:

a microchannel tube having a plurality of straight sections interconnected by a plurality of bent sections;

a plurality of accordion-style fins located between adjacent straight sections of the microchannel tube; and a plurality of brackets having a plurality of slots formed therein that are each configured for receipt of a respective straight section of the microchannel tube, wherein the plurality of brackets are configured to orient adjacent straight sections of the microchannel tube such that the plurality of accordion-style fins located between the adjacent straight sections of the microchannel tube are compressed by the adjacent straight sections of tube, and wherein the accordion-style fins are compressed by the adjacent straight sections of the microchannel tube a distance that lies in the range of 0.003 inches to 0.015 inches.

2. The heat exchanger according to claim 1, wherein at least one of the accordion-style fins and the microchannel tube includes a mating feature that prevents lateral movement of the accordion-style fin relative to the adjacent straight sections of the microchannel tube.

3. The heat exchanger according to claim 1, wherein the accordion-style fins are not brazed to the adjacent straight sections of microchannel tube.

4. The heat exchanger according to claim 2, wherein the microchannel tube includes a planar upper major surface and a planar lower major surface, and the mating feature includes at least one protrusion that extends longitudinally along each of the planar upper surface and the planar lower surface, and the accordion-style fin positioned between adjacent straight sections of microchannel tube includes a pair of recesses that are configured to mate with a respective protrusion formed on the adjacent straight section of microchannel tube.

5. The heat exchanger according to claim 4, wherein a plurality of laterally spaced apart protrusions are formed on each of the planar upper major surface and the planar lower major surface, and the accordion-style fin positioned between adjacent straight sections of microchannel tube includes a plurality of recesses that are configured to mate with respective protrusions formed on the adjacent straight section of microchannel tube.

6. The heat exchanger according to claim 2, wherein the microchannel tube includes a planar upper major surface and a planar lower major surface, and a pair of side surfaces that connect the planar upper major surface and the planar lower major surface, and wherein the mating feature includes a bulbous portion formed at each side surface that defines an abutment surface that extends outward from at least one of the planar upper major surface and the planar lower major surface and contacts the accordion-style fin and restricts lateral movement of the accordion-style fin positioned between adjacent straight sections of the microchannel tube.

7. The heat exchanger according to claim 2, wherein the mating feature is a recessed section formed in the accordion-style fin at bent portions of the accordion-style fin, the recessed section being configured for receipt of a straight section of the microchannel tube such that the microchannel tube is restricted from moving laterally relative to the accordion-style fin.

8. The heat exchanger according to claim 7, wherein the recessed section has a depth that permits the bent portions of the accordion-style fin to extend outward from the microchannel tube.

9. The heat exchanger according to claim 8, wherein the accordion-style fin includes a pair of tabs at the recessed section that are bent away from the bent portion, and the microchannel tube is seated on the pair of tabs.

10. The heat exchanger according to claim 1, wherein the plurality of slots of the bracket are separated by a finger having a tapered distal end.

11. The heat exchanger according to claim 1, wherein the plurality of slots are formed as a plurality of apertures configured for receipt of the microchannel tube therein.

12. The heat exchanger according to claim 1, further comprising a pair of planar support members that sandwich the heat exchanger and are mated to the plurality of brackets.

13. A heat exchanger, comprising:

a microchannel tube having a plurality of straight sections interconnected by a plurality of bent sections;

a plurality of accordion-style fins located between adjacent straight sections of the microchannel tube; and a plurality of brackets having a plurality of slots formed therein that are each configured for receipt of a respective straight section of the microchannel tube, wherein the microchannel tube includes an upper major surface and a lower major surface that each include plurality of projections that extend longitudinally at least along each of the plurality of straight sections;

the accordion-style fins located between adjacent straight sections of microchannel tubes include a plurality of recesses that are configured to mate with the plurality of projections such that when the recesses are mated with the projections, the accordion-style fins are restricted from moving laterally relative to the adjacent straight sections of the microchannel tube; and wherein the accordion-style fins are compressed by the adjacent straight sections of the microchannel tube a distance that lies in the range of 0.003 inches to 0.015 inches.

14. The heat exchanger according to claim 13, wherein each accordion-style fin includes a plurality of planar portions connected by bent portions, the bent portions being configured to contact the upper and lower major surfaces of the microchannel tube when the accordion-style fin is positioned between adjacent straight sections of the microchannel tube, and the recesses are formed at the bent portions.

15. The heat exchanger according to claim 14, wherein the bent portions are not brazed to the upper and lower major surfaces of the adjacent straight sections of microchannel tube.

16. The heat exchanger according to claim 13, wherein the plurality of brackets are configured to orient adjacent straight sections of the microchannel tube such that the plurality of accordion-style fins located between the adjacent straight sections of the microchannel tube are compressed by the adjacent straight sections of tube.

17. The heat exchanger according to claim 13, wherein the plurality of slots of the bracket are separated by a finger having a tapered distal end.

18. The heat exchanger according to claim 13, further comprising a pair of structural members attached to the brackets that sandwich the heat exchanger.

19. The heat exchanger according to claim 13, wherein mating between the plurality of protrusions and plurality of recesses does not restrict longitudinal movement of the accordion-style fin relative to the adjacent straight sections.

20. A heat exchanger, comprising:

a microchannel tube having a plurality of straight sections interconnected by a plurality of bent sections;

a plurality of accordion-style fins located between adjacent straight sections of the microchannel tube; and a plurality of brackets having a plurality of slots formed therein that are each configured for receipt of a respective straight section of the microchannel tube, wherein the plurality of brackets are configured to orient adjacent straight sections of the microchannel tube such that the plurality of accordion-style fins located between the adjacent straight sections of the microchannel tube are compressed by the adjacent straight sections of tube, and wherein the plurality of slots of the bracket are separated by a finger having a tapered distal end.

* * * * *